US006128938A

United States Patent [19]

Plociennik et al.

[11] Patent Number: 6,128,938

[45] Date of Patent: Oct. 10, 2000

[54] METHOD OF ROLLING WIRE HAVING AT LEAST A FIRST AND A SECOND ROLLING STRAND

[75] Inventors: Uwe Plociennik, Ratingen; Hans-Erich Schneider, Kreuztal, both of Germany

[73] Assignee: SMS Schloemann-Siemag AG, Dusseldorf, Germany

[21] Appl. No.: 09/255,593

[22] Filed: Feb. 22, 1999

[30] Foreign Application Priority Data

Feb. 23, 1998 [DE] Germany ..... 198 07 559

[51] Int. Cl.[7] ..... B21B 13/08

[52] U.S. Cl. ..... 72/234

[58] Field of Search ..... 72/234, 227, 11.4, 72/8.6

[56] References Cited

U.S. PATENT DOCUMENTS 3,625,043 12/1971 Neumann et al. ..... 72/227

3,811,304 5/1974 Gorker ..... 72/114

5,174,142 12/1992 Pong ..... 72/250

*Primary Examiner*—Rodney A. Butler

*Attorney, Agent, or Firm*—Herbert Dubno

[57] ABSTRACT

A method of rolling rod in which at least first and second strands are jointly rolled in a mill line having at least one final multistrand stand operating at a rolling speed which is variable as a result of predictable rolling events. Downstream of this stand the strands are separated and passed through single-strand mill stands and loops are provided upstream of the first single-strand mill stand in each line. Each loop has a loop length which can vary between a minimum and a maximum value. Before each of the rolling events occur at least one of the loop lengths is changed to an event optimizing value.

11 Claims, 1 Drawing Sheet

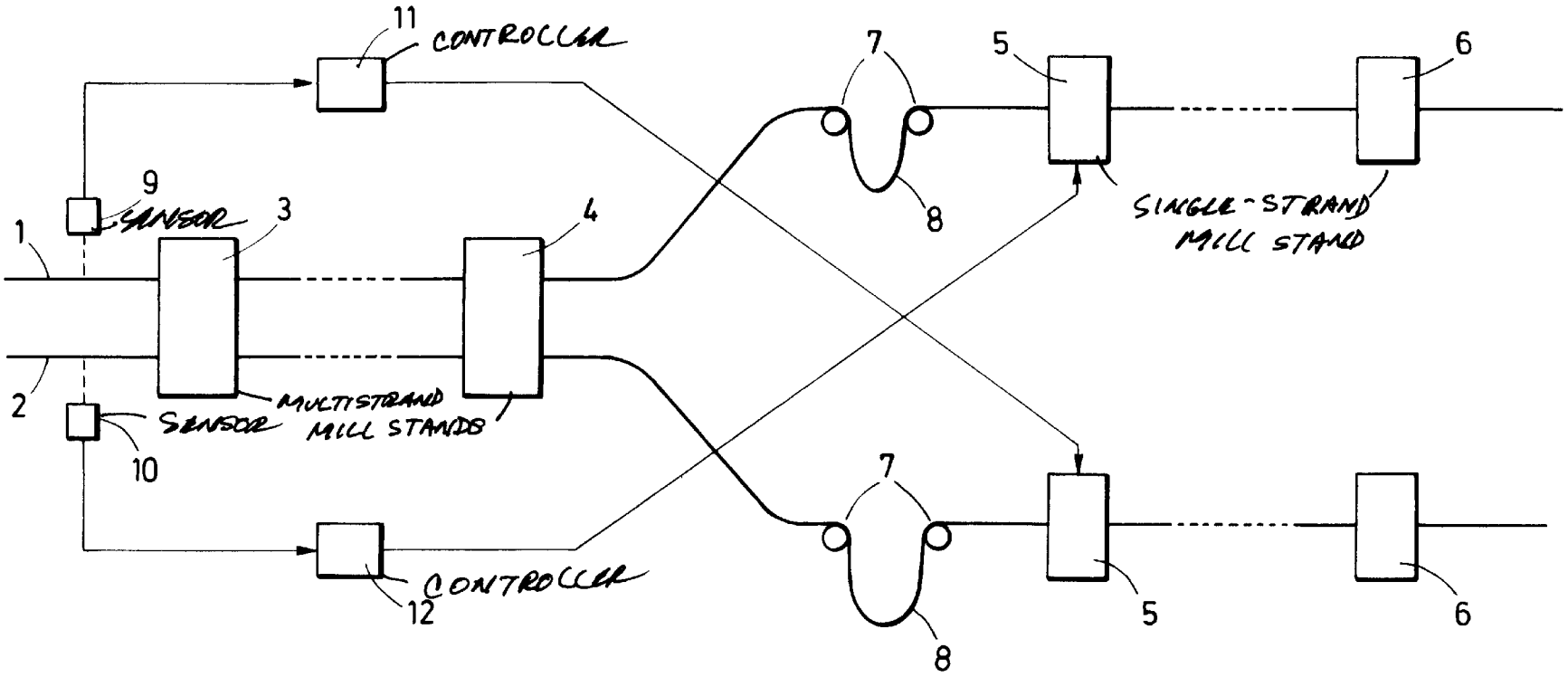
SINGLE-STRAND MILL STAND
MULTISTRAND MILL STANDS
SENSOR
SENSOR
CONTROLLER
CONTROLLER
1
2
3
4
5
5
6
6
7
7
8
8
9
10
11
12

METHOD OF ROLLING WIRE HAVING AT LEAST A FIRST AND A SECOND ROLLING STRAND

FIELD OF THE INVENTION

Our present invention relates to a rolling of wire or rod and more particularly to rolling as carried out in so-called rod mills or wire mills and in which the rolling is carried out with a plurality of strands. More particularly the invention relates to a rolling process for at least a first and a second rolled strand whereby a plurality of strands are rolled in a common mill stand (usually representing one of a number of mill stands and the rolling line strand are then separated and the strands are then rolled individually in respective mill stands, which may represent mill stands of respective rolling lines) and whereby each strand, before it enters its individual stand, is formed into a loop having a loop length which can vary between a minimum value and a maximum value.

BACKGROUND OF THE INVENTION

Rod mills of the aforedescribed type are used to roll so-called wire rod, generally in a hot rolling process, following which the rolled product can be drawn through a die to produce wire. The drawing process is usually a cold drawing while the rolling process is usually hot rolling.

The principles of rolling such wire rod are described inter alia, in The Making, Shaping and Treating of Steel, United States Steel Company, Pittsburgh, Pa., 1985, pages 963 ff.

When the initial rolling stages are carried out in common roll stands and the strands are then separated to form the respective loops and are then fed to individual mill stands, the multistrand rolling line can be either a preliminary rolling line, e.g. a roughing mill, or an intermediate line or mill. The single strand series of mill stands can be either intermediate lines or mills, or finishing lines or mills.

As a rule the individual strands are more or less uncoordinated with one another in the rolling operation. As a general matter, they arrive at and leave the mill stands independently of one another and without coordination within the various lines or mills and that applies as well to the entry of a strand to be milled into a common stand or the departure of the end of the strand from a common stand.

However, with each arrival of the leading end of a strand at the common mill stand and with each departure of a trailing end of the rolled stock from such a common mill stand, there is a change in the springing of the frame of the stand, which gives rise to a change in the cross section of the strand which was previously in or was still between the rolls of the mill stand. Because of this change in cross section there is a change in rolling speed. Such speed changes are compensated by the loops which lie downstream of the last common mill stand of the roughing or intermediate mill line or upstream of the individual stand of the subsequent intermediate rolling or finished rolling lines.

The loops have a loop length which can be measured from one end of the loop to the other or simply as the depth of the loop which fluctuates between a minimum value and a maximum value. The minimum value which can correspond to elimination of the loop (minimum value equals zero) occurs as the trailing end of the strand, which has left the common mill stand, is about to enter the individual mill stand. In all cases, therefore, the minimum value of the loop length will be zero. The maximum value of the loop length will depend on the construction of the line and how the latter is operated.

In the normal case the loop length should be midway between the maximum and minimum values and hence approximately half the maximum value. The speed of the mill downstream of the loop can be varied to maintain or restore the loop length at half of the maximum value. Since the maximum speed change arises as the leading end of a strand enters the mill stand or the trailing end of a strand leaves the mill stand, the maximum variation in the loop occurs at these times and by maintaining a half maximum length loop, fluctuations in either direction of the mill stand speed can be readily compensated and effective results from a point of view of the control dynamics can be obtained.

OBJECTS OF THE INVENTION

It is the principal object of the present invention to provide a method of operating a mill of the type described which facilitates better compensation for the sudden changes in speeds of a rolling mill stand than has been possible heretofore.

Another object of the invention is to provide an improved method of rolling wire rod, whereby control from a dynamic point of view can be improved and drawbacks of earlier systems can be reduced or avoided.

SUMMARY OF THE INVENTION

These objects and others which will become apparent hereinafter are attained, in accordance with the invention whereby before known events which can give rise to changes in the rolling speed, the loop lengths of the strands are adjusted to an event-optimizing value.

More particularly, the invention is a method of rolling wire rod according to the invention in a rolling line having at least one rolling mill stand in which a plurality of strands are jointly rolled and wherein the strands are then separated and are fed to individual rolling mill stands and loops are formed upstream of this latter strand. The method comprises the steps of:

(a) rolling at least a first and a second strand jointly in at least one multistrand mill stand operating at a rolling speed (v) variable as a result of predictable rolling events;

(b) downstream of the multistrand mill stand separately rolling each of the strands in at least one respective single-strand mill stand;

(c) forming a loop in each of the strands after the respective strand leaves the multistrand mill stand and before each strand enters the respective single-strand mill stand, each loop having a loop length (L) variable between the minimum value ($L_{min}$) and a maximum value ($L_{max}$); and (d) before each of the rolling events changing at last one of the loop lengths to an event-optimizing value.

Preferably the multistrand mill stand is the last stand of a series of multistrand mill stands forming a roughing line or an intermediate line and the single-strand mill stands are each the upstream stand of a series of such stands forming an intermediate mill line or a finishing line.

According to a feature of the invention, the events in question are the entry of one of the strands into the multistrand mill stand and the departure of one of the strands from the multistrand mill stand.

According to a feature of the invention, the first strand is fed to the multistrand mill stand prior to the second strand and the loop length of the loop of the first strand is reduced to close to its minimum value prior to entry of the second strand into the multistrand mill stand.

When the first strand departs from the multistrand mill stand prior to the second strand, the loop length of the loop of the second strand is increased to close to its maximum value prior to departure of the first strand from the multistrand mill stand.

According to a feature of the invention, the strands can be sensed upstream of the multistrand mill stand and the loop length can be controlled in response to the sensed strands.

With the invention, dynamic changes in the loop control can be minimized, the mechanical dimensions of the loop-forming unit can be reduced and the effective capacity of the loop can be increased. The other advantages of the invention include elimination of drawbacks in the binding of the wire rod downstream of the mill, reduced temperature sensitivity and reduced diameter variation in the rolled rod.

While the invention is specially especially for two-strand mills it is applicable to rolling of any number of strands wherein the departure of a strand from a common mill stand or the arrival of a strand at a common mill stand can give rise to diameter speed fluctuations in the manner previously described.

BRIEF DESCRIPTION OF THE DRAWING

The above and other objects, features, and advantages will become more readily apparent from the following description, reference being made to the sole Figure of which is a diagram illustrating the principles of the present invention.

SPECIFIC DESCRIPTION

As can be seen from the drawing, a first rolled strand 1 and a second rolled strand 2 are initially rolled in a line equipped with a plurality of multistrand rolling mill stands 3 . . . 4. Of this line only the first multistrand or common roll stand 3 and the last multistrand or common roll stand 4 have been illustrated. The rolled strands 1, 2 traverse the last multistrand rolling stand with a rolling speed v.

Downstream of this last multistrand rolling stand 4, the strands 1 and 2 are separated. Each of the individual strands 1 and 2 is fed to a single-strand rolling line in which the rolled strands 1, 2 are individually further rolled. Each of the single-strand lines itself is a multi-stand rolling line of which only the first single-strand mill stand 5 and the last single-strand mill stand 6 has been shown.

In order to compensate for speed jolts or transients as may arise at the last multistrand stand 4, ahead of each first single strand mill stand 5 for each strand 1, 2, a loop-forming unit 7 is provided. The loop-forming unit 7 forms respective loops 8 in the strands 1, 2 which can have loop lengths varying between zero as the minimum ($L_{min}$) and a maximum value ($L_{max}$). The maximum value $L_{max}$ is determined by the structural and operating conditions. As a rule, the loop length L has been adjusted to be about half of the maximum value $L_{max}$ so as to be able to compensate for speed fluctuations in both directions.

The multistrand rolling line is provided with a detection system which can have sensors 9, 10 capable of detecting when a leading or trailing end of a strand 1 or 2 is passing the respective sensor 9, 10. The sensors may be optical sensors or any other type of sensor capable of detecting the presence/absence of the strand or the material of the strand or sensitive to material like that constituting the strand.

In combination with known data of the rolling program, stored for example in the controllers 11 and 12, the controllers 11, 12 determine the point in time at which the respective strand is about to enter or leave the last multistrand mill stand 4. The controllers 11, 12 of one strand operate the single-strand mill at the inlet to the single-strand lines for the opposite strand to establish the respective loop lengths L at optimum levels.

More concretely when a second strand 2 is about to enter the multistrand mill stand 4, the loop length L of the first strand 1 is reduced below 25% of the maximum loop length $L_{max}$, assuming that the first strand 1 is already being processed in the mill stand 4. The optimum value to which the loop length is reduced is between 10 and 15% of the maximum loop length. The loop length 1 is increased to at least 75% and preferably between 85 and 90% of the maximum loop length $L_{max}$ for the loop of the second strand 2 before the first strand 1 leaves the multistrand mill stand 4 when the first strand leaves the latter before the second strand 2. The controllers operate alternatingly in this manner so that what has been said for the first strand as it arrives at or the second strand as it leaves the mill stand 4 equally triggers the reduction in the loop length of the second strand or the increase in the loop length of the first strand, respectively.

We claim:

1. A method of rolling rod comprising the steps of:

(a) rolling at least a first and a second strand jointly in at least one multistrand mill stand operating at a rolling speed (v) variable as a result of predictable rolling events;

(b) downstream of said multistrand mill stand separately rolling each of said strands in at least one respective single-strand mill stand;

(c) forming a loop in each of said strands after the respective strand leaves said multistrand mill stand and before each strand enters the respective single-strand mill stand, each loop having a loop length (L) variable between a minimum value ($L_{min}$) and a maximum value ($L_{max}$); and (d) before each of said rolling events changing at least one of said loop lengths to an event-optimizing value.

2. The method defined in claim 1 wherein said events are the entry of one of said strands into said multistrand mill stand and the departure of one of said strands from said multistrand mill stand.

3. The method defined in claim 1 wherein said first strand is fed to said multistrand mill stand prior to said second strand and said loop length of the loop of said first strand is reduced to close to said minimum value prior to entry of said second strand into said multistrand mill stand.

4. The method defined in claim 1 wherein the first strand departs from said multistrand mill stand prior to said second strand and the loop length of the loop of said second strand is increased to close to said maximum value prior to departure of said first strand from said multistrand mill stand.

5. The method defined in claim 2 wherein said strands are rolled jointly in a series of multistrand mill stands upstream of said loops and are rolled each in a series of single-strand mill stands downstream of said loops.

6. The method defined in claim 3 wherein the first strand departs from said multistrand mill stand prior to said second strand and the loop length of the loop of said second strand is increased to close to said maximum value prior to departure of said first strand from said multistrand mill stand.

7. The method defined in claim 6 wherein said strands are rolled jointly in a series of multistrand mill stands upstream of said loops and are rolled each in a series of single-strand mill stands downstream of said loops.

8. The method defined in claim 6, further comprising the steps of sensing said strands upstream of said multistrand mill stand and controlling said loop lengths in response to the sensed strands.

9. The method defined in claim 4 wherein said strands are rolled jointly in a series of multistrand mill stands upstream of said loops and are rolled each in a series of single-strand mill stands downstream of said loops.

10. The method defined in claim 4, further comprising the steps of sensing said strands upstream of said multistrand mill stand and controlling said loop lengths in response to the sensed strands.

11. The method defined in claim 5, further comprising the steps of sensing said strands upstream of said multistrand mill stand and controlling said loop lengths in response to the sensed strands.

* * * * *